US008491352B2

(12) United States Patent
Fong

(10) Patent No.: US 8,491,352 B2
(45) Date of Patent: Jul. 23, 2013

(54) SINGLE PIECE ABDOMINAL SUPPORT GARMENT

(76) Inventor: Theresa Fong, Hopkinton, MA (US)

( * ) Notice: Subject to any disclaimer, the term of this patent is extended or adjusted under 35 U.S.C. 154(b) by 624 days.

(21) Appl. No.: 12/661,475

(22) Filed: Mar. 18, 2010

(65) Prior Publication Data

US 2011/0230121 A1 Sep. 22, 2011

(51) Int. Cl.
*A41C 1/00* (2006.01)
*A41C 1/08* (2006.01)

(52) U.S. Cl.
USPC ..... 450/94; 450/96; 450/155

(58) Field of Classification Search
USPC ..... 450/94, 155, 102–105, 116, 117, 450/122, 123, 125, 126, 127, 133, 97, 96; 128/99.1, 100.1, 101.1
See application file for complete search history.

(56) References Cited

U.S. PATENT DOCUMENTS

| | | | | |
|---|---|---|---|---|
| 3,931,816 | A * | 1/1976 | Waldmann | 602/19 |
| 4,108,149 | A * | 8/1978 | Castiglia | 450/155 |
| 5,094,648 | A | 3/1992 | Turner | |
| 5,217,403 | A * | 6/1993 | Nobbs | 450/155 |
| 5,702,286 | A | 12/1997 | Seering et al. | |
| 6,817,034 | B2 | 11/2004 | Smilovic | |
| 7,008,292 | B2 * | 3/2006 | Cosentino et al. | 450/155 |
| 7,181,775 | B2 | 2/2007 | Carney | |
| 2009/0113596 | A1 | 5/2009 | Young | |
| 2009/0270012 | A1 | 10/2009 | Melarti et al. | |

FOREIGN PATENT DOCUMENTS

| | | |
|---|---|---|
| WO | WO 2006/118839 | 11/2006 |
| WO | WO 2007/127442 | 11/2007 |

OTHER PUBLICATIONS

International Search Report including Written Opinion for corresponding International Serial No. PCT/US2012/064347 mailed Jan. 25, 2013.

* cited by examiner

*Primary Examiner* — Gloria Hale
(74) *Attorney, Agent, or Firm* — Lando & Anastasi, LLP

(57) ABSTRACT

A single piece garment for those having a distended abdomen, said garment extending upwards from the groin to beneath the breasts. The garment comprises an inner layer and an outer layer. The inner layer has several elastomeric fabrics having differing modulus of elasticity. A section beneath the abdomen is formed from an anisotropic elastomeric fabric with a low modulus of elasticity that supports a distended abdomen. Side panels extending upwards from the abdomen across the hips to the lumbar region are made from an isotropic elastomeric fabric having a moderate modulus of elasticity. These connect to a rear panel across the lumbar of an anisotropic elastomeric fabric having a moderate modulus of elasticity. The directionality of the anisotropic elastomeric fabrics is from the abdomen across the hips to the lumbar region. The entire garment has an outer layer of an isotropic elastomeric fabric with a relatively low modulus of elasticity except for an elastomeric fabric across the lumbar region formed from a high modulus anisotropic elastomeric fabric.

20 Claims, 3 Drawing Sheets

FRONT VIEW

FRONT VIEW

BACK VIEW

SIDE VIEW

FRONT VIEW

SIDE VIEW

SINGLE PIECE ABDOMINAL SUPPORT GARMENT

BACKGROUND OF THE INVENTION

1. Introduction

This invention relates to a single piece abdominal support garment that provides support to areas of the abdomen and distributes a portion of the weight of the abdomen to the hips and lumbar, all areas that are subject to stress due to abdominal distention, especially distension occurring during pregnancy.

2. Description of the Prior Art

It is known that abdominal distention due to excess weight causes pain. Though not limited to pregnancy, abdominal distention is especially encountered during pregnancy. In this respect, it is known that there is substantial weight gain during pregnancy, especially during the latter 20 gestational weeks. Weight increase during pregnancy may often reach 40 pounds or more with 70% of the increase occurring during the last 20 gestational weeks. This increase is largely due to water retention, an increase in fat reserve, and the weight of the fetus.

It is also known that during pregnancy, the joints, ligaments and muscle structure of the pelvis and spine are particularly lax. The increased joint laxity and elasticity allows an easier adaptation of the pelvic shape to the fetus.

Further, it is known that during pregnancy, due to changes in the hormonal state, relaxation of the ligament and tendon system occurs along with an increase in the level of the progesterone hormone. This relaxation affects the whole body and becomes particularly apparent at the sacroiliac joints and at the pubic symphysis resulting in a greater stretching of the ligaments and a corresponding increase in pain derived from the stress exerted by the swelling of the uterus. At the vertebral level, particularly in the lumbar tract, ligamentous laxity may cause microstrains against the articular facets resulting in lower back pain. Moreover, at the lower lumbar vertebrae and at the lumbosacral passage, where the compressive stress on the vertebral bodies and the vertebral disks concentrate, a greater rate of disk protrusions occurs. The latter are also enhanced by greater laxity of the posterior longitudinal ligament with resulting compression creating lower back pain.

The relaxation of the ligament system during pregnancy also causes a spreading apart of the pelvic bones. In particular, the diastasis of the pubic symphysis causes a symptomatology represented by pubic and lumbosacral nerve pain enhanced by motion making walking difficult.

The above described symptoms are very frequent during pregnancy with an incidence that tends to increase during the course of the pregnancy as the uterine volume and weight increase until reaching its maximum around the end of the eighth month when approximately three women out of four intensely suffer from these conditions.

There are many factors contributing to pain during pregnancy. As the dimension of the abdomen and weight of the uterus increase coupled with relaxation of the abdominal wall, the center of gravity shifts forwards causing lumbar stress. This results in modification of the spine morphology including an abnormal forward curvature of the spine in the lumbar region, a backward shifting of the sacrum causing a progressive verticalization of the lumbosacral angle, a stretching of the sacroiliac joints, and finally a stretching against the pubic symphysis. At times, also sciatic neuralgia from herniated disc-deriving discoradicular compression is developed. To compensate for the above, the shoulders, the neck and the head are brought backwards, and the pelvis is slightly rotated onto the femurs. These modifications in posture induce pregnant women to assume a typical waddling gait with overloading of the vertebrae and of the related intervertebral disks.

Many maternity garments, especially undergarments, have been developed over the years to better support women during pregnancy. For example, U.S. Pat. No. 5,094,648 discloses a maternity support top with a built in bra and with a two-inch bellyband that lifts weight off of the pelvis. This garment focuses only on the upper torso of a pregnant woman and does not address the hip or buttock area.

U.S. Pat. No. 5,702,286 discloses a back and abdominal support worn over the brassiere and under the panties with a supportive band under the abdomen. However, this garment does not smooth and support the hip and buttock areas, but only acts as a supportive piece, not a shaping or smoothing piece.

U.S. Pat. No. 7,181,775 discloses a knit fabric band that is worn over pants that are too tight or too loose, holding them in place. The band is worn as a single layer over the abdomen as it grows. The band, however, does not address the torso or the back and does not act as a support function. Additionally, the band does not provide a shaping function and does not improve the woman's silhouette.

U.S. Pat. No. 6,817,034 discloses a full body slip that shapes and supports the torso, smoothed the thighs, buttocks, and waist. However, an abdominal panel is only supported by a narrow strip and functions solely as a support for the belly. The design disadvantageously prevents the wearer from wearing pants because the full body slip is shaped in a tubular fashion, necessarily extending and reaching far down the leg.

Patent Application Publication No. 2009/0270012 discloses a mild support to shape a woman's body. The garment has a shoulder strap, a belly panel, a hip band, and two side panels, and a back panel made of high performance fabric with varying degrees of compression. Though providing improvement over similar garments such as those described above, it fails to provide full relief from all discomfort resulting from the distended abdomen.

From the above, it is apparent that known maternity support and under garments disadvantageously target only a specific area of the body and solves only a limited number of problem areas. Therefore, a need exists for an all-in-one garment that addresses several areas including the smoothing of a woman's profile, the improvement of her level of comfort, the provision of needed support in all areas impacted by the pregnancy and compliments desired aesthetics.

DEFINITIONS

For purposes of the description that follows, terms used in this specification are defined as follows:

Modulus of elasticity is used in accordance with its customary meaning and is defined as the mathematical description of an object's or substance's tendency to be deformed elastically (i.e., non-permanently) when a force is applied to it. As used herein, it is used in connections with elastomeric fabrics and is expressed in pounds per square inch ($lbs/in^2$).

Isotropic, as applied to elastomeric fabrics, means the mechanical properties of an elastomer are the same in all directions, that is the elastomer is capable of stretching along all of its axes.

Anisotropic, as applied to elastomeric fabrics, means that the fabric is stretchable in two directions only, but resistant to stretching along any other axis.

SUMMARY OF THE INVENTION

Broadly, the garment of the present invention is a single piece garment extending upwards from the groin to above the abdomen but below the breasts. The garment of the invention is especially useful for women during pregnancy but is also suitable for anyone having a significantly distended abdomen.

Preferably, the garment of the invention comprises an inner layer and an outer layer. The inner layer of the garment comprises several elastomeric fabrics having differing moduli of elasticity. A section immediately beneath the abdomen comprises an anisotropic elastomeric fabric with a relatively low modulus of elasticity intended to lend support to the distended abdomen. Side panels extending upwards from the area beneath the abdomen across the hips to the lumbar region are made from an isotropic elastomeric fabric that has a moderate modulus of elasticity. In a preferred embodiment, a rear panel across the lumbar region comprises an anisotropic elastomeric fabric also having a relatively moderate modulus of elasticity. The directionality of both anisotropic elastomeric fabrics is latitudinal, that is it stretches from side to side, from the abdomen, across the hips to the lumbar region. The area overlaying the groin desirably comprises of a soft fabric. The balance of the garment comprises an isotropic elastomeric fabric with a relatively low modulus of elasticity. The entire garment has an outer layer of an isotropic elastomeric fabric with a relatively low modulus of elasticity except for an elastomeric fabric across the lumbar region formed from a high modulus anisotropic elastomeric fabric.

In use, the garment is designed to provide lift and support beneath the abdomen while distributing a portion of the weight of the abdomen through the side panels across the hips to the lumbar region. This design is intended to provide comfort to the individual wearing the garment thereby relieving the symptomatology described above. With minor modification of the design of the garment, it can be utilized by one experiencing modest weight gain, medium weight gain, or significant weight gain. It should be recognized that modest, medium and significant weight gain is relative to the individual characteristics of the user such as height, weight prior to gain, strength, etc.

The major portion of the description that follows is directed to the use of the garment during pregnancy, but it should be understood that the garment is also suitable for use by anyone with a significantly distended abdomen.

DECRIPTION OF THE PREFERRED EMBODIMENTS

The garment of the invention utilizes elastomeric fabrics. Elastomeric fabrics are well known in the art. They may be woven or non-woven. Examples of fabrics made from elastomers include those made from block copolymers of vinyl arylene and conjugated diene monomers, natural rubbers, polyurethane rubbers, polyester rubbers, elastomeric polyolefins and polyolefin blends, elastomeric polyamides, or the like. Elastomeric fabrics may also be formulated from a blend of two or more elastomeric polymers of the types previously described. For instance, one useful group of elastomeric polymers are the block copolymers of vinyl arylene and conjugated diene monomers, such as AB, ABA, ABC, or ABCA block copolymers where the A segments comprise arylenes such as polystyrene and the B and C segments comprise dienes such as butadiene, isoprene, or ethylene butadiene. Suitable block copolymer resins are readily available from KRATON® Polymers of Houston, Tex. or Dexco® Polymers LP of Planquemine, La. Another useful group of elastomeric polymers are polyolefinic elastomers (POEs) which are elastomeric copolymers of polyethylene or polypropylene. Suitable POEs are available from The Dow Chemical Company of Midland, Mich. or ExxonMobil Chemical Company of Houston, Tex. Most of such fabrics are isotropic in that the stretch is in all directions. Anisotropic elastomeric fabrics are used less frequently but are also well known in the art. They are made from many of the same materials as the isotropic fabrics but the method of manufacture limits the ability of the fabric so that it stretches in essentially two dimensions. Publications showing the manufacture of anisotropic elastomer fabrics include WO/2006/118839 and WO/2007/127442, both incorporated herein by reference.

Figure 1:
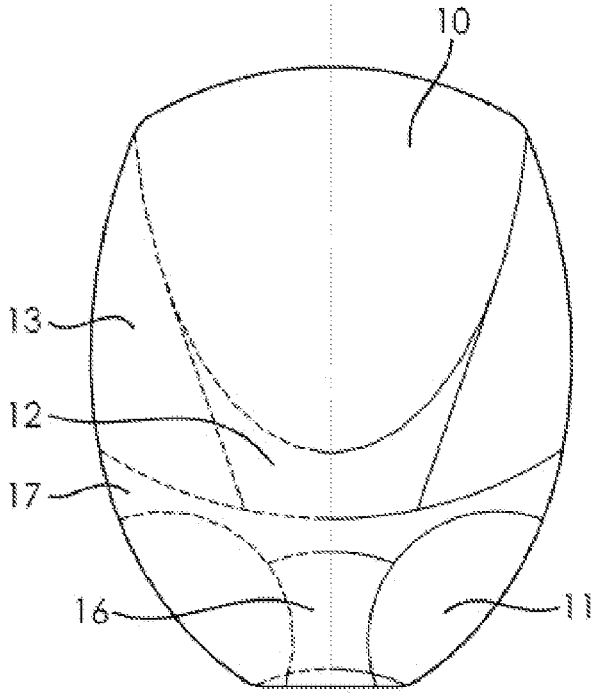
FIG. 1 is a frontal view of one embodiment of garment of the invention shown partly in section.
Figure 2:
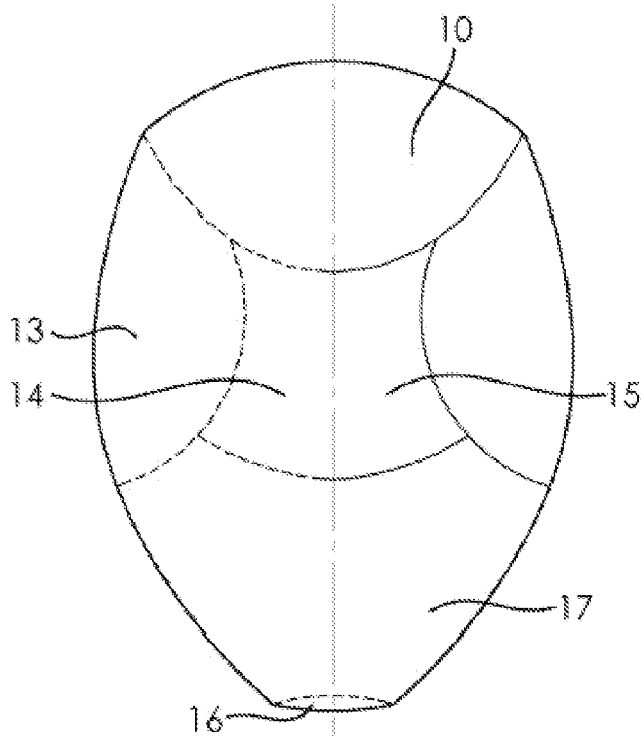
FIG. 2 is a rear view of the embodiment of FIG. 1 also shown partly in section.

The invention will be better understood by reference to the drawings where FIGS. 1 and 2 of the drawings represent sectional front [FIG. 1] and rear [FIG. 2] views of a preferred embodiment of the maternity garment of the invention. Like parts in each Figure have the same numbering. In each of FIGS. 1 and 2, the area to the left of the section line illustrates the inner layer of the garment while the area to the right of the section line illustrates the outer layer of the garment. As shown, the garment 10 has openings 11 for insertion of the legs enabling the user to don the garment. With reference to that section of the garment illustrated to the left of the section line in FIG. 1, there is shown panel 12 displaced beneath and in a supporting relationship to a distended abdomen. This panel is formed from an anisotropic elastomeric fabric having a relatively low modulus of elasticity and is intended to provide moderate support for the distended abdomen. The directionality of the stretch of this fabric is latitudinal, that is from side to side or from the hip to the lumbar region. The modulus of elasticity of panel 12 can vary within relatively broad limits but preferably the modulus of elasticity is within the range of at from 3 $lb/in^2$ to about 8 $lb/in^2$.

Two side panels 13 are displaced immediately adjacent to panel 12 and extend upwards and to the rear from each side of panel 12. These panels are formed from an isotropic elastomeric fabric having a moderate modulus of elasticity. The modulus of elasticity of each panel 13 is desirably at least 1.5 times that of panel 12 and can vary within relatively broad limits. Preferably each panel 13 has a modulus of elasticity of at least 4.5 $lb/in^2$ and preferably, the modulus varies within a range of from abut 6 to 12 $lb/in^2$. Each panel 13 joins to a side of back panel 14 and 15 located over the lumbar region and each is indented to distribute the weight of the distended abdomen to the lumbar region. With reference to FIG. 2 illustrating the back of the garment, partially in section, there is shown back panel 14 made of an anisotropic elastomeric fabric having a relatively low modulus of elasticity. In the embodiment shown in FIG. 2, the modulus of elasticity of panel 14 is approximately the same as that for panel 12, the panel extending across the lower portion of the abdomen. What has been described is a preferred embodiment of the invention. An alternative embodiment is discussed below.

With further reference to FIG. 2 of the drawings, the outer layer of the garment is shown in section in that portion of the drawing to the right of the section line. As shown, panel 15 is located on the outer layer of the garment overlapping panel 14. Panel 15 is formed from an anisotropic elastomeric fabric where the direction of stretch is latitudinal, that is from side to side or from hip to hip. The modulus of elasticity of panel 15 is greater then the modulus for any of panels 12, 13 and 14 and can vary within relatively broad limits. Preferably, panel 15 has a modulus of elasticity at least twice that of panel 12, preferably, the modulus of elasticity is at least 6 lb/in$^2$, and most preferably varies within 6 to about 15 lb/in$^2$. Panel 15 is intended to bear a significant portion of the weight of the distended abdomen.

Completing the garment of FIGS. 1 and 2 is a soft fabric 16 of any suitable material such as cotton or acetate covering the groin portion of the garment. Also, completing the outer layer of the garment is a light weight isotropic fabric 17 covering a major portion of the garment including the abdomen. This fabric accommodates and provides additional support for the abdomen. In addition, fabric 17 enhances the appearance of the garment as it overlays a major portion of the panels discussed above. Fabric 17 may be formed from an elastomeric fabric or any other fabric capable of some degree of stretch such as lightweight cotton. The modulus of elasticity of fabric 17 is not critical and can vary within broad limits, but preferably has a modulus of elasticity of at least 2 lb/in$^2$ while not exceeding about 6 lb/in$^2$.

To assist in a better understanding of the garment described above, FIG. 3 of the drawings, partially in section, represents a side view of the outer surface of garment, again where like parts have the same numbering as in FIGS. 1 and 2. The garment 10 is shown with openings 11 for insertion of the legs enabling the user to don the garment. Shown in section are abdominal panel 12 and side panels 13 described above. The back support panel 15 overlays a second back support panel not shown, but illustrated as panel 14 in FIG. 2. The entire garment, preferably excluding back panel 15, is desirably covered with lightweight fabric 17.

FIGS. 1 and 2 represent a preferred embodiment of the invention. In a lesser preferred embodiment, panel 15 can replace panel 14 in the inner layer of the garment and the entire outer layer of the garment can be covered with lightweight fabric 17. This is a lesser preferred embodiment as a fabric having a relatively high modulus of elasticity may be uncomfortable when placed next to the skin of the individual wearing the garment.

The garment illustrated in FIGS. 1 and 2 of the drawings is designed for use by an individual experiencing moderate weight gain or having a moderately distended abdomen. For those individuals experiencing modest or minor weight gain, panel 14 may be eliminated altogether and the entire outer surface of the garment may be covered with lightweight fabric 17. Again, modest vs. moderate weight gain is correlated to the structure of the individual wearing the garment.

Figure 3:
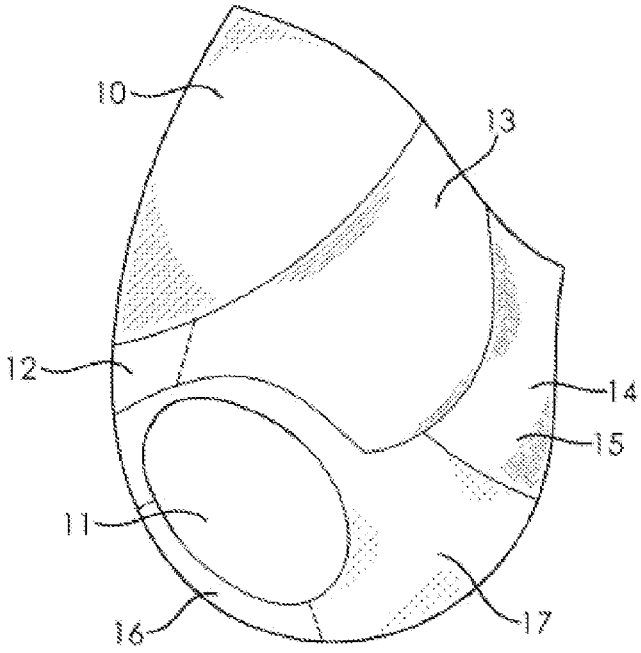
FIG. 3 is a side view of the garment shown in FIGS. 1 and 2.
Figure 4:
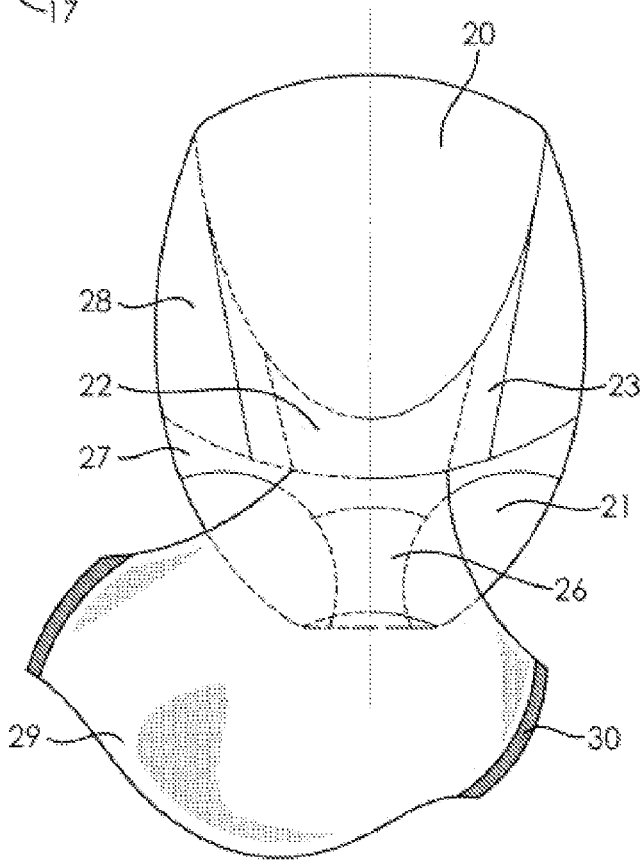
FIG. 4 is a frontal view of an enhanced embodiment garment of the present invention.
Figure 5:
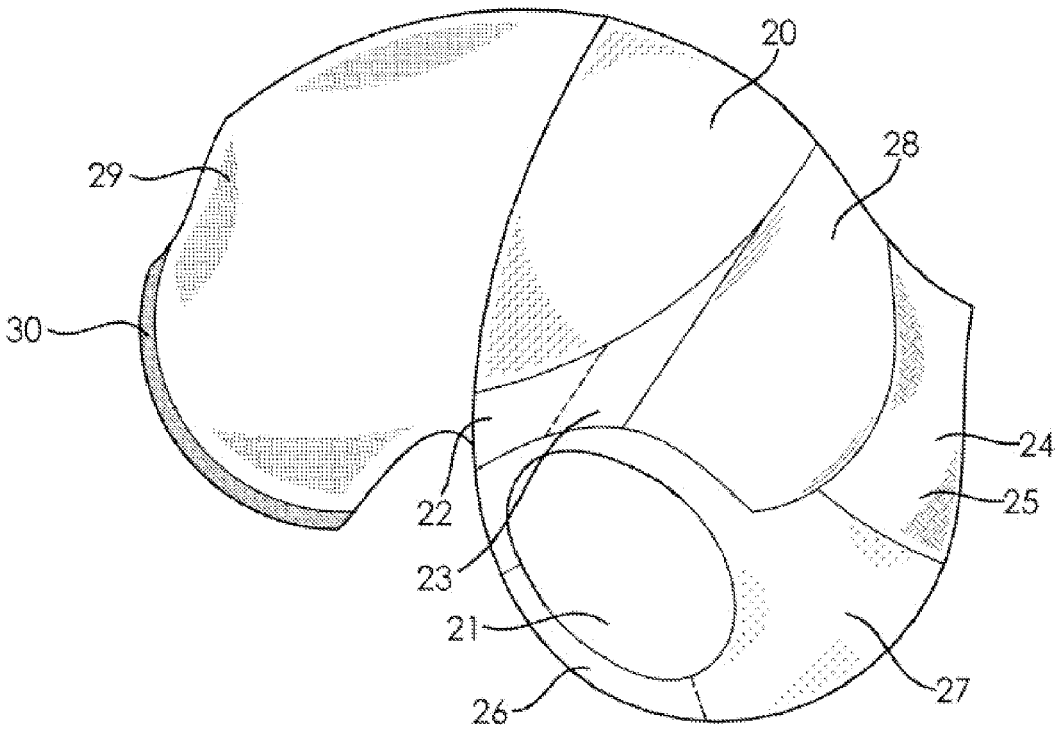
FIG. 5 is a side view of the garment shown in FIG. 4.

An alternative embodiment of the invention is shown in FIG. 4 [front view] and FIG. 5 [side view] of the drawings. This embodiment is intended for use with individuals where significant weight gain is encountered during pregnancy or the user has a large distended abdomen, thereby requiring greater support. The garment depicted in FIGS. 4 and 5 has many of its parts common to those shown in FIGS. 1 through 3. However, the garment of FIGS. 4 and 5 have features added to the garment to provide greater weight bearing support for the distended abdomen as required for those users having larger abdomen. For brevity, parts of the garment shown in FIGS. 4 and 5 common to parts of the garment illustrated in FIGS. 1 through 3 will only be briefly described. Additional abdominal support features added to the garment of this embodiment for greater abdominal support will be described in greater detail. In the discussion of FIGS. 4 and 5, like parts in each Figure have the same numbering. Both Figures are in partial section.

With reference to FIGS. 4 and 5, the garment 20 is shown having openings 21 permitting insertion of the legs into the garment enabling the user to don the garment. Panel 22 is analogous to panel 12 and is displaced beneath and in a supporting relationship to a distended abdomen. As in the embodiment shown in FIGS. 1 through 3, this panel is formed from an anisotropic elastomeric fabric having a relatively low modulus of elasticity and is intended to provide support for the distended abdomen. Again, the directionality of the stretch of this fabric is latitudinal, that is from side to side, and the modulus of elasticity preferably varies within a range of from about 3 lb/in$^2$ to about 8 lb/in$^2$.

Panels 23 on each side of the garment are displaced in close proximity to panel 22 and extend upwards and to the rear connecting to panel 28. As in the earlier described embodiment, these panels are formed from an isotropic elastomeric fabric having a moderate modulus of elasticity that is at least 1.5 times greater than that of panel 22. These panels have a modulus of at least 4.5 lb/in$^2$ and more preferably, a modulus varying within a range of from 6 to about 12 lb/in$^2$. In this embodiment of the invention, an additional panel 28 desirably is placed between panel 23 and panel 24 on each side of the garment. Panels 28 are formed from an isotropic elastomeric VELSTRETCH® (a hook and loop fastener) fabric having modulus of elasticity of at least 4.5 lb/in$^2$ and preferably, the modulus varies within a range of from about 6 to 12 lb/in$^2$. Panels 24 are formed from an isotropic elastomeric fabric having a relatively high modulus of elasticity and these panels are intended to provide additional support to the distended abdomen. The modulus of elasticity for panels 24 is about the same as the modulus for the high modulus back panels, panel 14 described above, and panel 25 described below, and varies from about 6 lb/in$^2$ to 15 lb/in$^2$.

With reference to FIG. 5, it can be seen that side panels 28 are joined to a back panel 25 located over the lumbar region. As in the garment of FIGS. 1 through 3, the back panel distributes the weight of the distended abdomen to the lumbar region. As depicted in FIG. 5 and analogous to the embodiment shown in FIGS. 1 through 3, back panel 25 is preferably located on the outer layer of the garment and covers an underlying panel 24 [not shown] in contact with the skin. As in the earlier described embodiment, the underlying back panel is formed from an anisotropic elastomeric fabric having a relatively low modulus of elasticity that is approximately the same as that for panel 22, the panel extending across the lower portion of the abdomen. The outer back panel 25 is formed from an anisotropic elastomeric fabric where the direction of stretch is latitudinal, that is from side to side. As discussed above, the modulus of elasticity of panel 25 is greater then the modulus for the other panels and has a modulus at least twice the modulus of panel 22. The modulus of elasticity of panel 25 desirably varies from about 6 lb/in$^2$ to 15 lb/in$^2$. Panel 25 provides a lift to the distended abdomen and distributes a portion of the same to the lumbar region. As in the embodiment described above, the underlying back panel may be eliminated and substituted with panel 25 though this is a lesser preferred embodiment due to likely discomfort to the user. Regardless of whether the anisotropic panel is in the outer or inner layer of the garment, its effect is the same.

The embodiment of the invention illustrated in FIGS. 4 and 5 of the drawings is intended to be used by those individuals experiencing significant weight gain or having a significantly distended abdomen. To support the greater stress on the abdomen, a flap 29 is added to the garment and attached to the garment in proximity to the bottom of abdominal panel 22. This flap is of an anisotropic fabric having a low modulus of elasticity where the direction of stretch is longitudinal, that is up and down, i.e., in the direction of from head to toe. The modulus of elasticity of this material is low and desirably, about the same as that for abdominal panel 22, that is at least 3 lb/in$^2$, and preferably not in excess of 8 lb/in$^2$. In use, the flap is raised upwards towards the top and to the sides of each side of panels 28 of the garment, stretched tightly over the abdomen and secured in place at the sides of the garment whereby it covers the abdomen and provides additional support for the abdomen. Any conventional means for securing the flap to the sides such as VELCRO® (a hook and loop fastner) strips, hooks, etc. can be used to secure the flap to the sides of the garment. In FIGS. 4 and 5, VELCRO® (a hook and loop fastner) strips 30 on flap 29 and corresponding to VELCRO® (a hook and loop fastner) strips (VELSTRETCH® (a hook and loop fastner) loop) 28 at the sides of the garment are illustrated.

As in the embodiment shown in FIGS. 1 through 3, completing the garment is a soft isotropic fabric 27 of any suitable material such as cotton or acetate covering the outer layer of the garment except for the abdomen which is covered by VELSTRETCH® (a hook and loop fastner) loop 28 and panels 24 and 25. This fabric enhances the appearance of the garment as it overlays a major portion of the panels discussed above. Fabric 27 may be formed from an elastomeric fabric or any other fabric capable of some degree of stretch such as lightweight cotton. The modulus of elasticity of fabric 27 is not critical and can vary within broad limits but preferably has a modulus of elasticity of at least 2 lb/in$^2$ while not exceeding about 6 lb/in$^2$.

The invention claimed is:

1. A garment to support a distended abdomen, said garment having an abdominal panel displaced beneath and in a position to support a distended abdomen, said panel being formed from an anisotropic elastomeric fabric that stretches in a latitudinal direction, two side panels, each panel being secured to a side of said abdominal panel, each said side panels extending upwards and to a rear of said abdominal panel and being formed from an isotropic elastomeric fabric having a modulus of elasticity at least 1.5 times greater than said abdominal panel, and a back panel over the lumbar region of a wearer attached to each of said side panels.

2. The garment of claim 1 being a one piece garment extending upwards from the groin to below the breasts the wearer.

3. The garment of claim 1 where said back panel is formed from an anisotropic elastomeric fabric that stretches in a latitudinal direction and has a modulus of elasticity at least twice that of said abdominal panel.

4. The garment of claim 1 where said garment except the back panel is covered by an outer layer of an isotropic fabric.

5. The garment of claim 4 where the back comprises a portion of the outer layer of said garment.

6. The garment of claim 5 where the back panel is displaced over an inner layer back panel formed from an elastomeric fabric.

7. The garment of claim 1 having a flap attached in proximity to the abdominal panel that fold upwards and has means to securely attach said flap to the sides of the garment.

8. The garment of claim 7 where the flap is formed from an anisotropic elastomeric fabric that stretches in a longitudinal direction.

9. The garment of claim 8 where the modulus of elasticity of said flap is approximately the same as that for the abdominal panel.

10. The garment of claim 7 having panels disposed between said abdominal panel and said side panels, said panels being formed from an isotropic elastomeric fabric having a modulus of elasticity approximately equal to said abdominal panel.

11. The garment of claim 1 where the modulus of elasticity for the abdominal panel is at least 3 lb/in$^2$.

12. The garment of claim 1 where the modulus of elasticity for said back panel is at least 6 lb/in$^2$.

13. A one piece pregnancy garment, said garment having an abdominal panel displaced beneath and in a position to support a distended abdomen, said panel being formed from an anisotropic elastomeric fabric that stretches in a latitudinal direction, two side panels, each secured to a side of said abdominal panel, each said side panels extending upwards and to the rear of said abdominal panel and being formed from an isotropic elastomeric fabric having a modulus of elasticity at least 1.5 times greater than said abdominal panel, and a back panel over the lumbar region of a wearer attached to each of said side panels, said back panel being formed from an anisotropic elastomeric fabric that stretches in a latitudinal direction and has a modulus of elasticity at least twice that of said abdominal panel.

14. The pregnancy garment of claim 13 extending upwards from the groin to below the breasts of the wearer.

15. The pregnancy garment of claim 13 where said pregnancy garment, except the back panel, is covered by an outer layer of an isotropic fabric and the back panel is comprises a portion of the outer layer of said garment.

16. The pregnancy garment of claim 15 where the back panel is displaced over an inner layer back panel formed from an elastomeric fabric.

17. The pregnancy garment of claim 13 having a flap attached in proximity to the abdominal panel that fold upwards and has means to securely attach said flap to the sides of the garment where the modulus of elasticity of said flap is approximately the same as that for the abdominal panel.

18. The pregnancy garment of claim 17 having panels disposed between said abdominal panel and said side panels, said panels being formed from an isotropic elastomeric fabric having a modulus of elasticity approximately equal to said abdominal panel.

19. The pregnancy garment of claim 13 where the modulus of elasticity for the abdominal panel is at least 3 lb/in$^2$.

20. The pregnancy garment of claim 13 where the modulus of elasticity for said back panel is at least 6 lb/in$^2$.

* * * * *